United States Patent [19]

Lindberg

[11] Patent Number: 4,888,527

[45] Date of Patent: Dec. 19, 1989

[54] REACTANCE TRANSFORMER CONTROL FOR DISCHARGE DEVICES

[76] Inventor: Peter J. Lindberg, 36407 Dowling, Livonia, Mich. 48150

[21] Appl. No.: 120,466

[22] Filed: Nov. 13, 1987

[51] Int. Cl.[4] ..... H05B 41/16

[52] U.S. Cl. ..... 315/282; 315/287

[58] Field of Search ..... 315/194, 282, 284, 285, 315/287

[56] References Cited

U.S. PATENT DOCUMENTS

| | | | |
|---|---|---|---|
| 4,162,429 | 7/1979 | Elms et al. | 315/284 |
| 4,350,933 | 9/1982 | Agarwala et al. | 315/278 |
| 4,350,934 | 9/1982 | Spreadbury | 315/282 |
| 4,384,239 | 5/1983 | Davenport | 315/282 |
| 4,562,384 | 12/1985 | Owen | 315/276 |

*Primary Examiner*—Robert L. Griffin
*Assistant Examiner*—T. Salindong
*Attorney, Agent, or Firm*—Reising, Ethington, Barnard, Perry & Milton

[57] ABSTRACT

A high leakage reactance transformer especially for current limited control of gas discharge lamps and other electrical discharge loads has a core with three legs defining two magnetic loops. A first leg has an air gap with a fixed reluctance, a second leg is common to both loops and has a primary winding, and the third leg has a supply winding for connection to the discharge device as well as a control winding connected to a control circuit. The control winding has an adjustable load to vary the reluctance of the third leg and control the current limit of the supply winding. Linear and proportional control circuits are shown.

6 Claims, 3 Drawing Sheets

REACTANCE TRANSFORMER CONTROL FOR DISCHARGE DEVICES

FIELD OF THE INVENTION

This invention relates to a control for electrical discharge devices such as gas discharge lamps and more particularly to such a control using a dual secondary high leakage reactance transformer.

BACKGROUND OF THE INVENTION

It is desirable to control gas discharge devices to assure accurate and consistent output. For example, gas discharge lamps are very useful for photographic enlargers since they can be formed to any size and shape to uniformly illuminate a negative and they allow excellent choices of appropriate light wavelengths. Such sources have not become popular for that purpose since the available power supplies allow the light output to drift. Thus a better control is needed, although gas discharge loads present special control problems.

When an AC source applies voltage to a gas discharge lamp the gas is not ionized at the beginning of each half-cycle and has an extremely high impedance. When the voltage becomes high enough to ionize the gas, current flows and light is emitted at a level proportional to the current. The ionized gas presents a low impedance load and the voltage necessary to sustain the discharge is much lower than the voltage required to initiate the discharge. Indeed, if the higher voltage is maintained after ionization, the current through the small impedance becomes large enough to destroy the lamp. As the voltage drops at the end of the half-cycle the discharge is extinguished and the process repeats in each half-cycle. These non-linearities put peculiar demands on the power source and uniform control of the light output is difficult to attain with prior power supplies.

The standard device for supplying current limited power to a gas discharge tube is a high leakage reactance transformer. Such a reactance transformer, as known in the prior art, is shown in FIG. 1. A three-legged magnetic core 10 has a first leg 12 containing an air gap 13 and has a specific constant magnetic reluctance determined by the size of the gap. A second leg 14 comprising a center leg has a primary winding 16 for connection to an AC supply. The third leg 18 has a secondary winding 20 for connection to the gas discharge load. The flux path through the second and third legs links the primary and secondary windings and forms a first loop A. The flux path through the second and first legs forms a second loop B.

The loop A has a variable reluctance dependent on the secondary load while the loop B has a fixed reluctance which is much greater than the unloaded loop A. At low load, the loop A will have most of the flux flowing through it and the secondary voltage will be high. As the load increases, the reluctance of loop A increases and the secondary voltage decreases. As the load on the secondary winding approaches an electrical short, the majority of the flux flows through the loop B because its fixed reluctance is now lower than the high reluctance of loop A. Thus at low secondary voltage the current is high and is limited to a value set by the fixed reluctance loop B.

When the high leakage reactance transformer drives a gas discharge lamp, a waveform like that of FIG. 2 is generated. The sinusoidal AC open circuit voltage is shown in dotted lines. The voltage across the lamp reaches the ionization voltage C and then drops to level D when secondary current flows at a value determined by the current limiting transformer. The current is shown on the same graph. When the voltage drops below the discharge sustaining level E the current is extinguished. Then the process is repeated in the next half-cycle. Since the light output is proportional to lamp current, it is essentially constant during the periods of current conduction. The overall light output is subject to drifting and moreover there is a need for light level adjustment to dim the illumination when desired.

Several prior proposals have addressed the illumination control problem as shown in the following U.S. patents. Spreadbury U.S. Pat. No. 4,350,934 shows an inductive reactance for discharge device control having a gap in one leg and a control winding on that leg for varying the value of the reactance to control the supply current or the power consumed by the device. Increased current in the control winding increases the reluctance of that leg to increase the current limit in the other leg. The supply current to the device thus can be varied between a limit set by the gap and an unlimited destructive value. The transformer cannot be controlled to diminish the current below the value set by the gap. Elms U.S. Pat. No. 4,162,429 shows a variable reactor for discharge lamp control having a core similar to that of FIG. 1 herein except that each leg contains a gap. A separate starter winding and a specific control circuit are provided. Owens U.S. Pat. No. 4,562,384 shows a discharge lamp ballast having a core with a pair of shunts and windings only on the leg of the core containing the gap. Additional controls for transformer supplied discharge lamps are revealed by Davenport U.S. Pat. No. 4,384,239 and Agarwala U.S. Pat. No. 4,350,933.

SUMMARY OF THE INVENTION

It is therefore an object of the invention to provide a power supply for a discharge device having accurate and uniform control of the discharge output. It is a further object to provide such a control which is both compact and inexpensive.

The invention is carried out by a control for a discharge device comprising a control circuit, a high leakage reactance transformer having first and second magnetic loops, the loops having a common portion, and the first loop having a constant reluctance, primary winding means on the common portion of the loops, and secondary winding means on the second loop, the secondary winding means including terminals for coupling to a discharge device and for coupling to the control circuit, the control circuit having means for regulating the current to the discharge device by selectively loading the secondary winding means, whereby the current limit of the discharge device is controlled by the control circuit.

BRIEF DESCRIPTION OF THE DRAWINGS

The above and other advantages of the invention will become more apparent from the following description taken in conjunction with the accompanying drawings wherein like reference numerals refer to like parts and wherein.

DESCRIPTION OF THE PREFERRED EMBODIMENT

Figure 1:
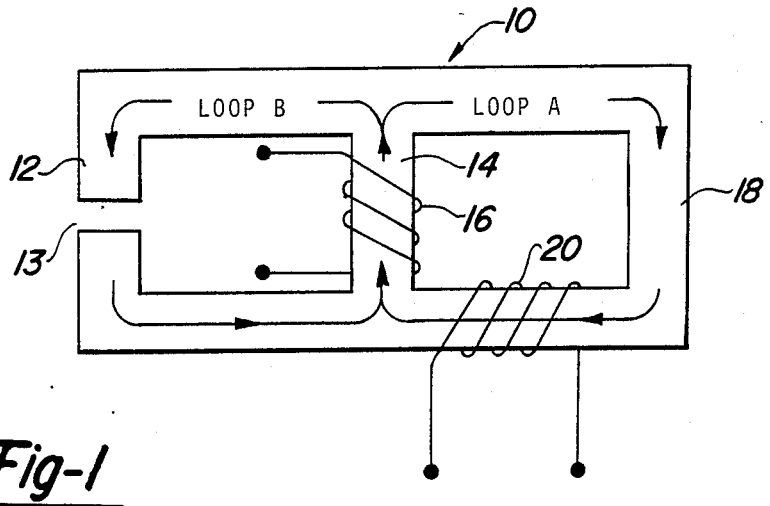
Fig-1 (PRIOR ART)
FIG. 1 is a schematic diagram of a high leakage reactance transformer in accordance with the prior art.
Figure 2:
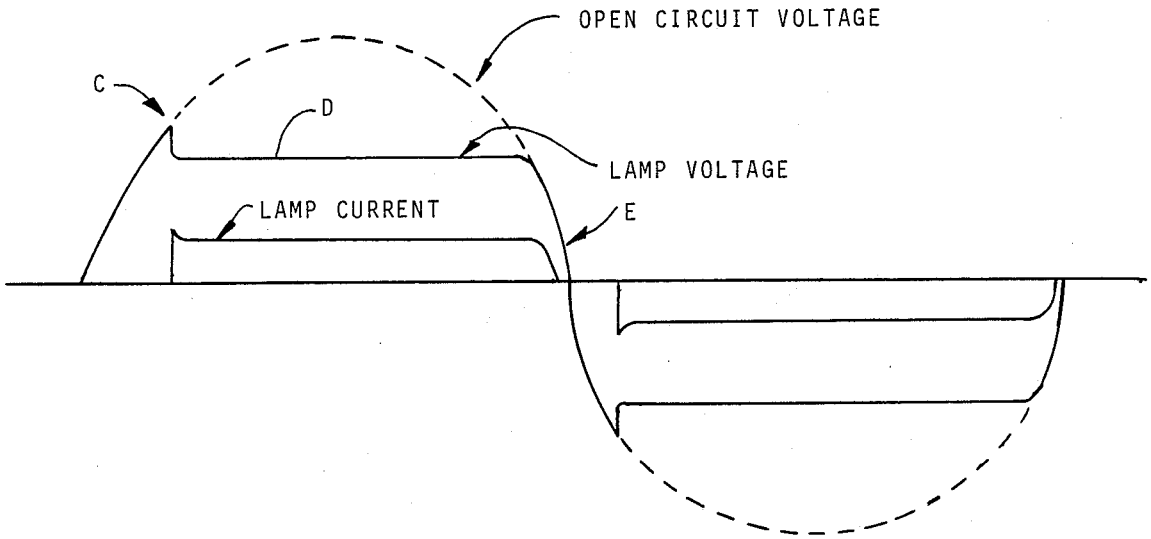
FIG. 2 is a waveform diagram of voltage and current characteristics of a discharge lamp supplied by the transformer of FIG. 1.
Figure 3:
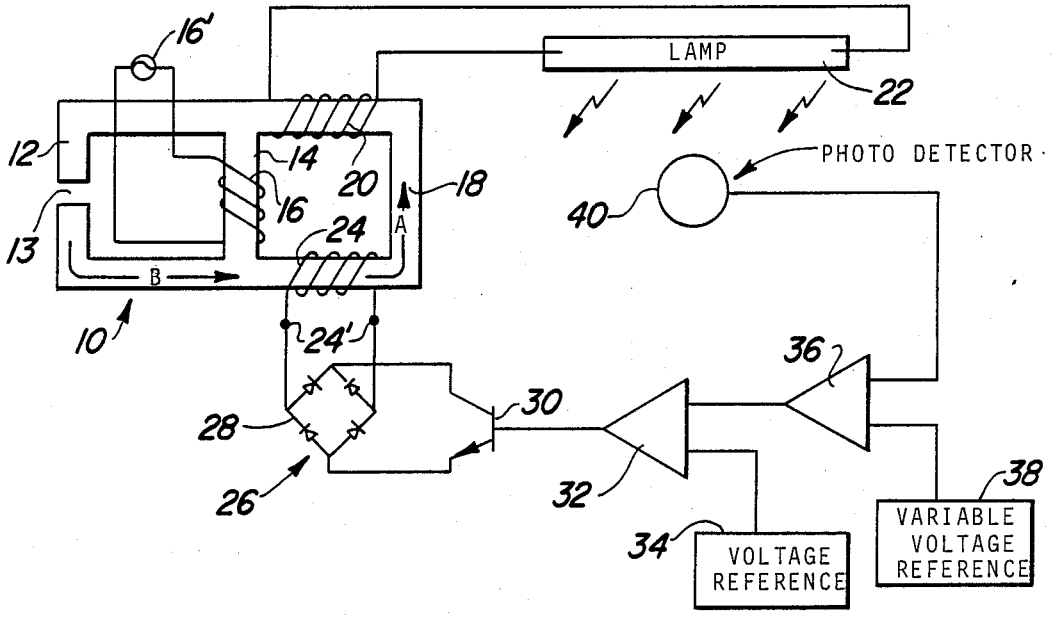
FIG. 3 is a schematic diagram of a linear modulation control having a high leakage reactance transformer according to the invention.

FIG. 3 shows a linear modulation control for a gas discharge lamp 22. The control uses a dual secondary high leakage reactance transformer which is like the configuration of FIG. 1 except that the leg 18 has an additional secondary winding 24 which serves as a control winding. A variable impedance 26 is coupled across the control winding 24 to vary the load on the winding 24 and thus vary the reluctance of the leg 18. The lamp 22 is supplied by the supply winding 20. The primary winding is connected across the power line source 16'.

When two identical secondary windings are placed in the magnetic loop A of the high leakage reactance transformer, the current limit as set by the air gap in loop B will limit the sum of the currents of the two secondary windings. If the two secondary windings are not identical, their open circuit voltage ratio will be equal to their turns ratio and their short circuit current ratio will be the inverse of their turns ratio. The current limit as set by the air gap in the loop B will limit the sum of the currents of the two secondary windings as scaled by their turns ratio. It can be shown that:

$$T(I_{max1}-I_1)>=I_2,$$

where $E_1$=Secondary 1 open circuit voltage,
$E_2$=Secondary 2 open circuit voltage,
$I_{max1}$=Secondary 1 open circuit current,
$I_1$=Secondary 1 current,
$I_2$=Secondary 2 current, and
$T=E_1/E_2$ Thus it is possible to control the current limit of a secondary winding by selectively loading another secondary in the same magnetic loop.

The variable impedance 26 in the linear modulation control depicted in FIG. 3 selectively loads the control winding 24 to control the current limit of the supply winding 20. The impedance 26 could be a manually varied kind or it may be a voltage controlled impedance. As shown, the variable impedance 26 is a bridge rectifier across the terminals 24' of the control winding 24 and coupled across the emitter and the collector of a transistor 30. The transistor 30 is operated in its linear region to serve as a variable resistor controlled by its base voltage. The control voltage for the impedance 26 in turn can be manually controlled or automatically controlled. The drawing shows a closed loop feedback arrangement including an offset amplifier 32 supplied at one terminal by a voltage reference 34 and having its output connected to the base of the transistor 30 to establish a nominal control level. Another input to the offset amplifier 32 is supplied by an error amplifier 36 which in turn has its input terminals connected to a variable voltage reference 38 for setting a desired illumination level and to a photodetector 40 for sensing the actual illumination level from the lamp 22. The error amplifier 36 is a differential amplifier for comparing the outputs of the variable reference 38 and the photodetector 40 to produce an error signal acting through the offset amplifier 32 and the variable impedance 26 to control the load on the control winding 24 in a manner to diminish the error and normally will eliminate the error.

In operation, when the primary winding 16 is connected to an AC supply 16' line voltage, an alternating flux is generated in each loop. If the impedance 26 is very high, the reluctance of the third leg 18 is determined by the load imposed by the lamp 22 on the supply winding 20, thereby limiting the current in lamp 22 to a certain value. If the resultant light output yields a photodetector 40 voltage which is greater than the voltage reference from the variable source 38, the error amplifier will sense the difference and cause a decrease of the impedance 26. That action will allow a load in the control winding 24 which increases the reluctance of the leg 18 to decrease the limit current to lamp 22 and its light output. Of course, when the light output falls below the level represented by the reference voltage, the action reverses to increase the impedance 26 and increase the light output. This linear modulation works well when small amounts of control loading are used but as the control winding 24 becomes loaded the open circuit voltage output of the supply winding 20 decreases and can eventually drop so low that the voltage never rises high enough during that half cycle to initiate the ionization. At this point the discharge lamp 22 becomes erratic and unpredictable and precise control of the tube is lost.

Figure 4:
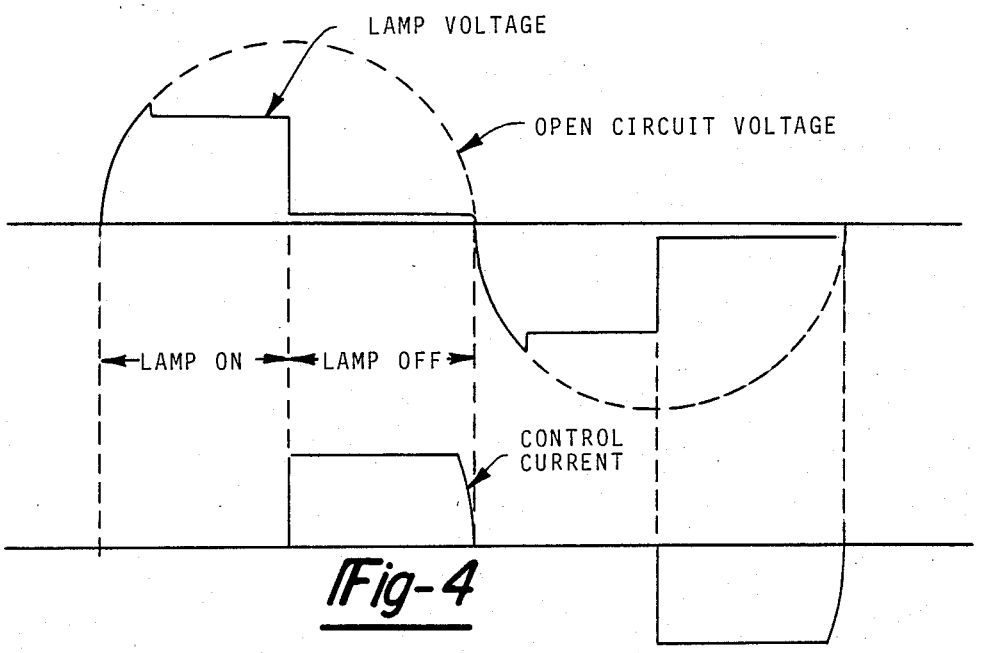
FIG. 4 is a waveform diagram of lamp voltage and control current characteristics of a transformer with synchronous modulation control.

Another control arrangement useful especially where control in the low illumination region may be desired uses proportional control. This is implemented by switching the control coil between open and short circuit conditions. FIG. 4 shows the lamp voltage and the control current in each half-cycle. At the beginning of the cycle when the control current is off, the lamp voltage is limited to a preset current limited level necessary to attain full illumination during the on period. When control current is turned on, the lamp voltage drops to a very low level and the lamp is extinguished. The average illumination is accurately controlled, even for low light levels, by controlling the time the secondary current is turned on, i.e., the on-off duty cycle of the lamp is controlled to obtain the desired light output. This is accomplished by synchronous switching of the control current where for a given duty cycle the switching takes place at the same place each half cycle, as shown in FIG. 4, or it can be accomplished by asynchronous switching which occurs independently of the phase of the line voltage. In the latter case, it is preferred to switch the control current on and off at a frequency higher than the line frequency to obtain several on and off periods in each half cycle. As in the case of synchronous control, the duty cycle determines the average light level for asynchronous control. These proportional control techniques have a nearly 100% control range because the luminous tube fully turns on each half cycle and only the on time is modulated.

Figure 5:
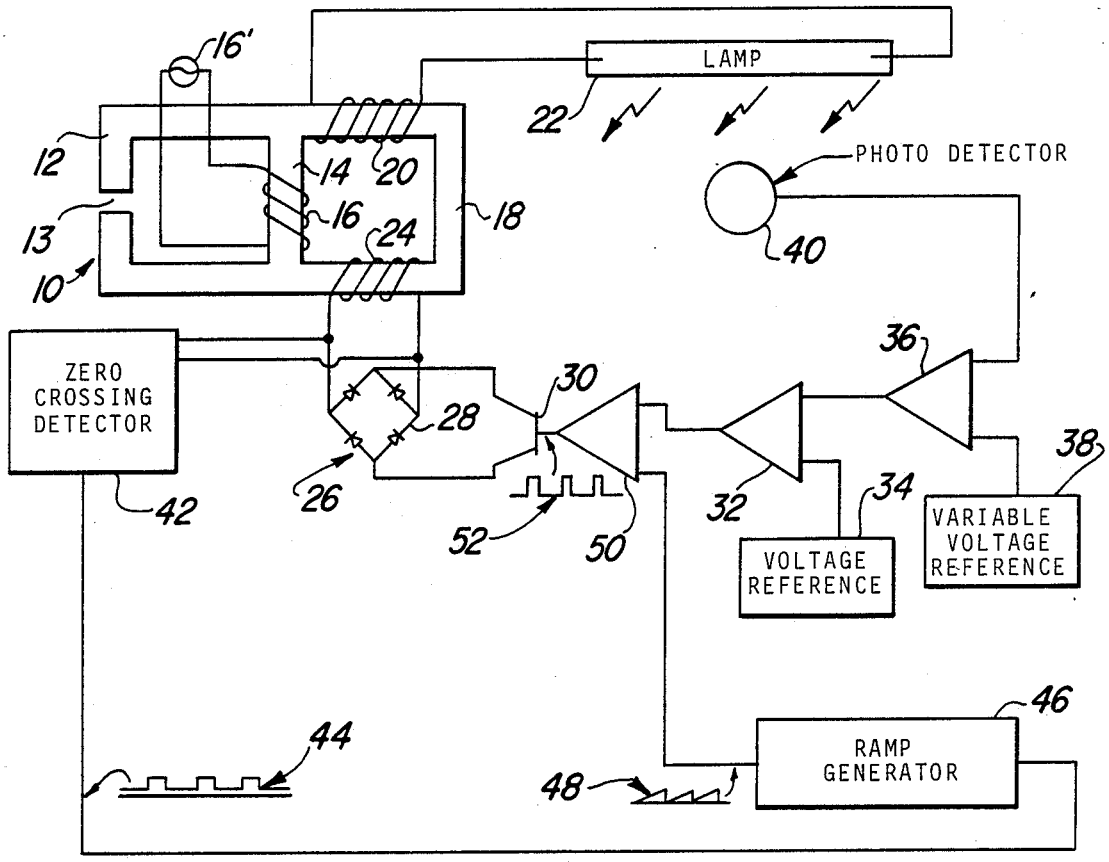
FIG. 5 is a schematic diagram of a proportional control including a high leakage reactance transformer according to the invention.

FIG. 5 shows a power line synchronous proportional control circuit. The dual secondary high leakage reactance transformer is the same as that described above. Similarly the lamp 22, the variable impedance 26, the offset amplifier 32, the voltage reference 34, the error amplifier 36, the variable voltage reference 38, and the photodetector 40 are the same as described for FIG. 3. A zero crossing detector 42 senses the zero crossings of the voltage induced in the control winding 24 and produces a square wave signal 44 indicating the beginning of each half cycle of the AC supply current. A ramp generator 46 coupled to the zero crossing detector 42 generates a saw tooth waveform signal 48 in phase with the zero crossings. A comparator 50 has its inputs connected to the outputs of the ramp generator 46 and the offset amplifier 32. The comparator output 52 is a pulse width modulated signal fed to the transistor 30 base to switch the transistor on and off.

In operation, the photodetector 40 output and the variable voltage reference 38 output are compared to control the output of the offset amplifier in the same manner as in the FIG. 3 embodiment. The resultant offset amplifier signal is used by the comparator 50 to set a threshold such that the comparator output 52 goes high when the ramp signal exceeds the threshold and goes low when the ramp signal drops below the threshold. The duty cycle or the pulse width of the signal 52 increases as the offset amplifier 32 voltage decreases, thereby increasing the time of conduction in the control winding 24 and decreasing the lamp 22 on period in each cycle. Thus the lamp is turned on and off in each half-cycle and the feed-back arrangement accurately maintains the light output at a level determined by the setting of the variable voltage reference. This circuit is capable of stabilizing the light output of the lamp to within tenths of a percent while maintaining an extremely large dynamic range.

This proportional control technique has a near 100% control range because the lamp fully turns on each half-cycle and only the time is modulated. Because either the shorted control secondary or the ionized lamp will be current limiting the transformer, transferring the load from one secondary to the other will not cause any large magnetic disruptions. This allows the load to be switched at any desired rate either synchronously or asynchronously to the power line.

It will thus be seen that the control for a gas discharge lamp or other discharge device as described herein has features of precision and a large working range not found in prior art controls. Another characteristic not described above is that the control package can be very compact compared to commercially available devices.

What is claimed is:

1. A control for a discharge device comprising:

a control circuit, a high leakage reactance transformer having a core with three legs defining first and second magnetic loops, the loops having a common portion, and the core in the first loop having a gap which exhibits substantially constant reluctance, primary winding means on the common portion of the loops, and secondary winding means on the second loop, the secondary winding means including terminals coupled to a discharge device and terminals coupled to the control circuit, the control circuit having means for regulating the current limit to the discharge device by selectively loading the secondary winding means, whereby the current limit of the discharge device is controlled by the control circuit.

2. A control for a discharge device comprising:

a high leakage reactance transformer having a core with three legs defining a pair of magnetic loops with a common leg, a primary winding on the common leg, one of the loops having a constant magnetic reluctance and having a gap in the core to establish the magnetic reluctance, secondary windings on the other loop having respective load terminals for coupling with a discharge device and having control terminals, and a control circuit connected to the control terminals for imposing a regulatable auxiliary load on a secondary winding effective to accurately limit the current to the load terminals to a determined value.

3. A current limiting power supply for controlling the light output of a gas discharge lamp comprising:

a high leakage reactance transformer having a core with three legs defining two magnetic loops with a common leg, one of the loops having a constant magnetic reluctance and having a gap in the core to establish the constant reluctance, an output winding on the other loop for connection to a gas discharge lamp, a control winding on the said other loop for regulating the loop reluctance to control the output current, and a control circuit coupled to the control winding comprising a variable impedance adjustable to load the control winding whereby the output current and light output are controlled by adjusting the impedance.

4. A current limiting power supply as defined in claim 3 wherein the control circuit has a closed loop linear modulation control including a photodetector for sensing light output and for generating a light level voltage, a variable voltage reference, means for comparing the light level voltage and the reference to yield an error signal, and means responsive to the error signal to vary the variable impedance to diminish the error, thereby regulating the light output according to the voltage reference.

5. A current limiting power supply for controlling the light output of a gas discharge lamp comprising:

a high leakage reactance transformer having a core with three legs defining two magnetic loops with a common leg, one of the loops having a constant magnetic reluctance and having a gap in the core to establish the magnetic reluctance, an output winding on the other loop for supplying an output to a gas discharge lamp, a control winding on the said other loop for regulating the loop reluctance to control the output current, the control winding being effective to selectively change the output to turn the lamp full on and full off, and a control circuit couples to the control winding comprising a variable impedance switchable between high and low values to selectively load the control winging sufficiently to extinguish the lamp and alternatively unload the control winding to turn the lamp full on, whereby the output current and light output are controlled by suitably switching the impedance to vary the duty cycle of the lamp.

6. A current limiting power supply as defined in claim 5 wherein the variable impedance comprises switch means connected across the control winding for periodically loading and unloading the control winding, and the control circuit has a closed loop proportional control including, a photodetector for sensing light output of the lamp and for generating a light level voltage, a variable voltage reference, means for comparing the light level voltage and the reference to yield an error signal, and means responsive to the error signal and coupled to the switch means to vary the duty cycle of the switch means in a manner to diminish the error, thereby regulating the light output according to the voltage reference.

* * * * *